US010119089B2

(12) United States Patent
Rinker et al.

(10) Patent No.: US 10,119,089 B2
(45) Date of Patent: Nov. 6, 2018

(54) COAL CHAR PASSIVATION PROCESS AND APPARATUS

(71) Applicant: C2O Technologies, LLC, Marco Island, FL (US)

(72) Inventors: Franklin G. Rinker, Marco Island, FL (US); Deane Avent Horne, Toledo, OH (US); Timothy J. Kuhn, Maumee, OH (US); Robert W. Mueller, Louisville, KY (US); James Darrell Kinder, Charlestown, IN (US)

(73) Assignee: C2O TECHNOLOGIES, LLC, Marco Island, FL (US)

( * ) Notice: Subject to any disclaimer, the term of this patent is extended or adjusted under 35 U.S.C. 154(b) by 1 day.

(21) Appl. No.: 15/309,592

(22) PCT Filed: May 6, 2015

(86) PCT No.: PCT/US2015/029390

§ 371 (c)(1),
(2) Date: Nov. 8, 2016

(87) PCT Pub. No.: WO2015/171710

PCT Pub. Date: Nov. 12, 2015

(65) Prior Publication Data

US 2017/0183589 A1 Jun. 29, 2017

Related U.S. Application Data

(60) Provisional application No. 61/911,141, filed on May 9, 2014.

(51) Int. Cl.
*C10L 9/08* (2006.01)
*C10B 47/20* (2006.01)
(Continued)

(52) U.S. Cl.
CPC ..... *C10L 9/08* (2013.01); *C10B 47/20* (2013.01); *C10B 51/00* (2013.01); *C10B 53/04* (2013.01);
(Continued)

(58) Field of Classification Search
CPC combination set(s) only.
See application file for complete search history.

(56) References Cited

U.S. PATENT DOCUMENTS 3,985,516 A * 10/1976 Johnson ..... C10L 9/10 34/369
3,985,517 A 10/1976 Johnson
(Continued)

FOREIGN PATENT DOCUMENTS

CN 102384469 A 3/2012
GB 1012575 A 12/1965

OTHER PUBLICATIONS

PCT International Search Report, Application No. PCT/US15/29390, dated Jul. 28, 2015.

*Primary Examiner* — Ellen M McAvoy
*Assistant Examiner* — Chantel L Graham
(74) *Attorney, Agent, or Firm* — MacMillan, Sobanski & Todd, LLC

(57) ABSTRACT

A continuous process and apparatus for treating dried coal and coal char to promote passivation of the reactive carbon particles by forming a protective oxide coating and simultaneously adding moisture to rehydrate said particles. The passivation process is conducted in a novel apparatus providing for the staged control of the reaction temperature and the staged introduction of both oxygen and moisture. The fluidized bed apparatus has internal in-bed cooling means embedded within the fluidized coal or coal char particles so
(Continued)

as to remove the heat energy as it is released by virtue of the exothermic passivation reactions.

12 Claims, 6 Drawing Sheets

(51) Int. Cl.

| | |
|---|---|
| ***C10B 53/04*** | (2006.01) |
| ***C10B 51/00*** | (2006.01) |
| ***C10L 9/00*** | (2006.01) |
| ***C10B 57/00*** | (2006.01) |
| ***C10L 9/06*** | (2006.01) |

(52) U.S. Cl.
CPC ..... *C10B 57/005* (2013.01); *C10L 9/00* (2013.01); *C10L 9/06* (2013.01)

(56) References Cited

U.S. PATENT DOCUMENTS

| | | | |
|---|---|---|---|
| 4,101,073 | A | 7/1978 | Curran |
| 5,601,692 | A | 2/1997 | Rinker et al. |
| 5,711,769 | A | 1/1998 | Rinker et al. |
| 2011/0011719 | A1 | 1/2011 | Rinker |
| 2011/0011720 | A1 | 1/2011 | Rinker |
| 2011/0011722 | A1 | 1/2011 | Rinker |
| 2012/0066967 | A1 | 3/2012 | Rinker |
| 2013/0062186 | A1 | 3/2013 | Rinker |
| 2014/0190074 | A1 | 7/2014 | Rinker et al. |

* cited by examiner

1500 MT/DAY

METRIC PROCESS FLOW TABLE FOR CHAR PASSIVATION

| | | | Char Passivation -Area 1700 | | | | | | | |
|---|---|---|---|---|---|---|---|---|---|---|
| Stream Description: | | | Char From Cooling | Char Passivation On-Gas | Rehydration Water Spray | Dry Atomizing Gas | Char Passivation Off-Gas | Char Passivation Loop Purge | Char Passivation Makeup Air | Char From Passivation |
| Stream #: | | | <95> | <121> | <122> | <123> | <124> | <125> | <126> | <127> |
| Temperature: | | °C | 49 | 46 | 16 | 24 | 43 | 43 | 16 | 52 |
| Pressure: | | kPag | 3.0 | 14 | 400 | 600 | 3 | 0.7 | 1.0 | 3.0 |
| Total Mass Flow: | | kg/hr | 30,948 | 39,236 | 1,748 | 540 | 39,667 | 1,100 | 668 | 32,805 |
| **GASES** | **MW** | | | | | | | | | |
| $CO_2$ | 44 | kg/hr | | 25 | | 0.3 | 25 | 0.7 | 0.4 | |
| $H_2O$ (g) | 18 | kg/hr | | 1,803 | | 0 | 1,849 | 51 | 5 | |
| $O_2$ | 32 | kg/hr | | 4,513 | | 125 | 4,483 | 124 | 154 | |
| Ar | 39.9 | kg/hr | | 550 | | 6.9 | 556 | 15 | 9 | |
| $N_2$ | 28 | kg/hr | | 32,346 | | 407 | 32,753 | 908 | 500 | |
| $H_2$ | 2 | kg/hr | | | | | | | | |
| CO | 28 | kg/hr | | | | | | | | |
| $CH_4$ | 16 | kg/hr | | | | | | | | |
| **LIQUIDS** | | | | | | | | | | |
| $H_2O$ (l) | 18 | kg/hr | | | 1,748 | | | | | |
| **SOLIDS** | | | | | | | | | | |
| Moisture: | | kg/hr | 0 | | | | | | | 1,702 |
| Volatiles: | | kg/hr | 5,608 | | | | | | | 5,763 |
| Fixed Carbon: | | kg/hr | 22,962 | | | | | | | 22,962 |
| Ash: | | kg/hr | 2,378 | | | | | | | 2,378 |
| Molecular Weight: | | g/mole | - | 27.8 | 18 | 29 | 27.8 | 27.8 | 28.8 | - |
| Volumetric Flow: | | Nm3/h | - | 31,611 | - | 418 | 31,978 | 886 | 519 | - |
| Volumetric Flow: | | Am3/h | - | 32,558 | - | 66 | 35,959 | 1,019 | 544 | - |
| Volumetric Flow: | | m3/hr | - | - | 1.8 | - | - | - | - | - |

Fig. 4A

1500 MT/DAY

ENGLISH PROCESS FLOW TABLE FOR CHAR PASSIVATION

| | | | Char Passivation -Area 1700 | | | | | | | |
|---|---|---|---|---|---|---|---|---|---|---|
| Stream Description: | | | Char From Cooling | Char Passivation On-Gas | Rehydration Water Spray | Dry Atomizing Gas | Char Passivation Off-Gas | Char Passivation Loop Purge | Char Passivation Makeup Air | Char From Passivation |
| Stream #: | | | <95> | <121> | <122> | <123> | <124> | <125> | <126> | <127> |
| Temperature: | | °F | 120 | 115 | 75 | 75 | 109 | 109 | 60 | 125 |
| Pressure: | | wc (psig) | 12 | 55 | (58.0) | (87) | 12 | 3.0 | 4.0 | 12.0 |
| Total Mass Flow: | | lb/hr | 68,229 | 86,500 | 3,855 | 1,190 | 87,451 | 2,424 | 1,473 | 72,322 |
| **GASES** | MW | | | | | | | | | |
| CO2 | 44 | lb/hr | | 55 | | 0.7 | 56 | 1.6 | 0.9 | |
| H2O (g) | 18 | lb/hr | | 3,975 | | 0 | 4,077 | 113 | 11 | |
| O2 | 32 | lb/hr | | 9,948 | | 276 | 9,883 | 274 | 339 | |
| Ar | 39.9 | lb/hr | | 1,212 | | 15 | 1,227 | 34 | 19 | |
| N2 | 28 | lb/hr | | 71,310 | | 898 | 72,209 | 2,002 | 1,103 | |
| H2 | 2 | lb/hr | | | | | | | | |
| CO | 28 | lb/hr | | | | | | | | |
| CH4 | 16 | lb/hr | | | | | | | | |
| **LIQUIDS** | | | | | | | | | | |
| H2O (l) | 18 | lb/hr | | | 3,855 | | | | | |
| **SOLIDS** | | | | | | | | | | |
| Moisture: | | lb/hr | 0 | | | | | | | 3,753 |
| Volatiles: | | lb/hr | 12,364 | | | | | | | 12,705 |
| Fixed Carbon: | | lb/hr | 50,623 | | | | | | | 50,623 |
| Ash: | | lb/hr | 5,243 | | | | | | | 5,243 |
| Weight: | | lb/mole | - | 27.8 | 18 | 29 | 27.8 | 27.8 | 28.8 | - |
| Volumetric Flow: | | SCFM | - | 19,673 | - | 260 | 19,901 | 552 | 323 | - |
| Volumetric Flow: | | ACFM | - | 19,163 | - | 39 | 21,165 | 600 | 320 | - |
| Volumetric Flow: | | gpm | - | - | 7.7 | - | - | - | - | - |

Fig. 4B

COAL CHAR PASSIVATION PROCESS AND APPARATUS

RELATED APPLICATIONS

The disclosures of all mentioned patent publications and applications are incorporated herein by reference in their entirety. This invention was made with no U.S. Government support and the U.S. Government has no rights in this invention.

TECHNICAL FIELD

The present invention relates to the field of coal processing, and more specifically to process and apparatus for improved passivation of pyrolized coal char. More specifically, the present invention relates to processes and apparatus for the more efficient recovery of (1) coal-derived liquids (CDLs) from the gases driven off, and (2) the char produced from coal during pyrolysis. It is applicable to bituminous, sub-bituminous and non-agglomerating lignite ranks of coal.

BACKGROUND OF THE INVENTION

Coal in its virgin state, particularly low rank coal, is sometimes treated to improve its usefulness and thermal energy content in a process known as beneficiation. The beneficiation treatment can include drying the coal and subjecting the coal to a pyrolysis process to drive off low boiling point organic compounds and heavier organic compounds. This thermal treatment of coal, also known as low temperature coal carbonization, causes the release of certain volatile hydrocarbon compounds having value for further refinement into liquid or gaseous fuels and other coal-derived liquids (CDLs) and chemicals. These volatile components can be removed from the effluent or gases exiting the pyrolysis process. The pyrolytic treatment of coal also leaves behind a product known as coal char, composed of carbon and non-volatile minerals, elements and ash.

Coal char, unless passivated, is highly susceptible to self combustion and cannot be stored easily. Thus, various processes have been developed to passivate coal char. One such pyrolysis and passivation process is disclosed in U.S. Pat. No. 5,601,692 to Rinker et al. Rinker et al. describe how coal is heated to as much as 590° C. during pyrolysis to drive off low end volatile components, after which the char readily reabsorbs moisture and oxygen from an ambient atmosphere in an exothermic process that is pyrophoric, or has the tendency to self ignite. To passivate the char particles, Rinker et al. rapidly decreases the temperature by 100° C. or more to a temperature of about 150° C. to about 200° C., by any conventional means such as spraying with water. The relatively large char particles are then conveyed to an oxidative passivation unit where the particles are contacted with an oxygen-containing process gas in a cross flow system that is isolated from ambient air. The process gas may contain from 3% to about 23% oxygen (by weight) depending inversely on its temperature. The process gas intermixes with the char particles producing two results: (a) extracting heat to cool the char particles further; and (b) producing a chemisorption of some of the oxygen onto or into the char particles. This chemisorption and rehydration reduces the propensity of the char to self-ignite, thereby rendering it suitable for storage, transport or further processing.

While the current passivation processes are valuable, they are time consuming and the oxidative chemisorptions step may need to be repeated once or more at lower temperatures to effect complete passivation. Furthermore, the chemisorption process itself is exothermic, so even if the char is cooled prior to passivation, additional heat is generated in the passivation process and must also be removed. Prior art methods to address this exothermic heat removal have generally involved the flow of large quantities of the recycle gas to limit the temperature increase. However, this become impractical when the heat removal demands of a rapid, continuous flow process are considered.

It would be advantageous if passivation processes could be improved to produce passivated char more quickly and/or using less energy. It would also be advantageous if passivation processes could be improved to permit more control over the factors of the passivation, such as the level of oxygen input to the system, the rate of moisture addition, or the rate and location at which heat is extracted.

SUMMARY OF THE INVENTION

In a broad aspect, a process for treating coal is described. The process builds on low temperature coal carbonization to separate coal into multiple components, including: coal char, coal-derived liquids (CDLs), and a gaseous fuel also known as syngas. The coal char is passivated in accordance with the invention prior to being manipulated further. The further manipulation may include storage or transportation, and may include bagging as fine char particles or briquetting into solid pellets.

For example, in one aspect the invention is a fluidized passivation bed apparatus for passivating coal char, the apparatus comprising:

a reaction chamber defining an interior and having a char inlet for receiving coal char into the interior and a char sump for allowing coal char to exit the interior;

the reaction chamber further including at least one gas inlet for admitting an oxygen-containing fluidizing gas into the interior, at least one gas outlet for allowing exit of the fluidizing gas from the interior, and a gas recirculation system comprising a source of fluidizing gas, one or more conduits and a pump, the conduits and pump arranged and adapted to recirculate the fluidizing gas from the gas outlet to the gas inlet under conditions to cause a fluidized state in the coal char within the interior of the reaction chamber;

at least one independent heat exchanger embedded within the interior of the reaction chamber, the heat exchanger having a coolant fluid inlet, a coolant fluid outlet and a plurality of contact surfaces for exchanging heat with coal char within the interior; and a humidifier connected to a source of water and adapted for humidifying the coal char.

The oxygen-containing fluidizing gas may be air; or a non-oxidative gas like nitrogen or carbon dioxide supplemented with oxygen from an oxygen source to desired oxygen levels for the oxygen-containing fluidizing gas. In the apparatus described above the humidifier may comprise a spray nozzle connected to a source of water and adapted to humidify the char by any or all of four possible mechanisms: (a) droplet spray onto char located in the interior of the reaction chamber; (b) droplet spray onto char at a location prior to its entry into the reaction chamber; (c) droplet spray into the interior of the fluidizing reaction chamber; and (d) droplet spray into the gas recirculation system so that the fluidizing gas is humidified.

The apparatus described above may include a plurality of internal heat exchangers and/or a plurality of gas inlets and outlets. When there are a plurality of heat exchangers, they may be arranged in parallel or in series, and in co-current or counter-current fashion. Heat exchangers are "independent" in that the coolant fluid of the heat exchanger never comes into direct contact with the char particles or the fluidizing gases. Instead, the system relies on heat exchange surfaces that contact the fluidized gases and char. Heat exchangers are "internal" in that the heat exchange surfaces that contact the fluidized gases and char are in the interior of the fluidized bed reactor.

The apparatus above may include a char sump having two portions, one for passivated char particles that are not entrained in the gas stream at time of exit and one for char particles that are entrained in the gas stream and are returned to the chamber via a cyclone separator.

In another aspect, the invention comprises a method of passivating coal char by processing it in the apparatus described above.

In another aspect, the invention comprises a method of passivating coal char by fluidizing the coal char particles with a fluidizing gas stream injected into the reaction chamber of a fluidized bed reactor; passivating the char particles as they are fluidized by contacting them with moisture and oxygen in the reaction chamber; and cooling the char particles as they are fluidized by contacting them with an independent heat exchange system having heat exchange surfaces within the fluidized bed reactor.

In the methods above, the process involves chemisorbing oxygen onto the surfaces or into the pores of the coal char particles; and contacting the coal char particles with moisture. The moisture may be provided by spraying water into the fluidized reaction chamber or by spraying water into the fluidizing gas stream prior to injecting it into the chamber.

In some embodiments, the temperature of the char in the fluidized bed reaction chamber is maintained from about 115° F. to about 135° F. (about 46° C. to about 57° C.). In some embodiments, the char particles are completely passivated in a time less than about 60 minutes, for example, in a time of 30 minutes, ±about 10 minutes. In some embodiments, the char in the fluidized bed reaction takes up oxygen from about 0.2% to about 0.7% by weight; typically from about 0.3% to about 0.6% by weight. In some embodiments, the char in the fluidized bed reaction takes up moisture from about 3% to about 7% by weight, for example, from about 4% to about 6% by weight.

The novelty presented herein is to perform the passivation reactions in a device whence the exothermic heat removal, the oxygen concentration in the fluidizing gas stream and the rate of moisture addition can be controlled and staged so as to carefully match the reaction dynamics of the exothermic reaction of passivation.

Various advantages of this invention will become apparent to those skilled in the art from the following detailed description of the preferred embodiment, when read in light of the accompanying drawings.

BRIEF DESCRIPTION OF THE DRAWINGS

FIGS. 4A and 4B are process flow tables showing in metric (4A) and English (4B) units passivation flows, temperatures, pressures, etc for various components of the gases, liquids and solids involved in an exemplary passivation process.

DETAILED DESCRIPTION OF THE INVENTION

Various embodiments are described herein in the context of methods and apparatus for passivating coal char. Those of ordinary skill in the art will realize that the following detailed description of the embodiments is illustrative only and not intended to be in any way limiting. Other embodiments will readily suggest themselves to such skilled persons having the benefit of this disclosure. Reference to an "embodiment," "aspect," or "example" herein indicate that the embodiments of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations or processes described herein are shown and described. It will, of course, be appreciated that in the development of any such actual implementation, numerous implementation-specific decisions will be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking for those of ordinary skill in the art having the benefit of this disclosure.

It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

Pyrolysis Process Overview

Figure 1:
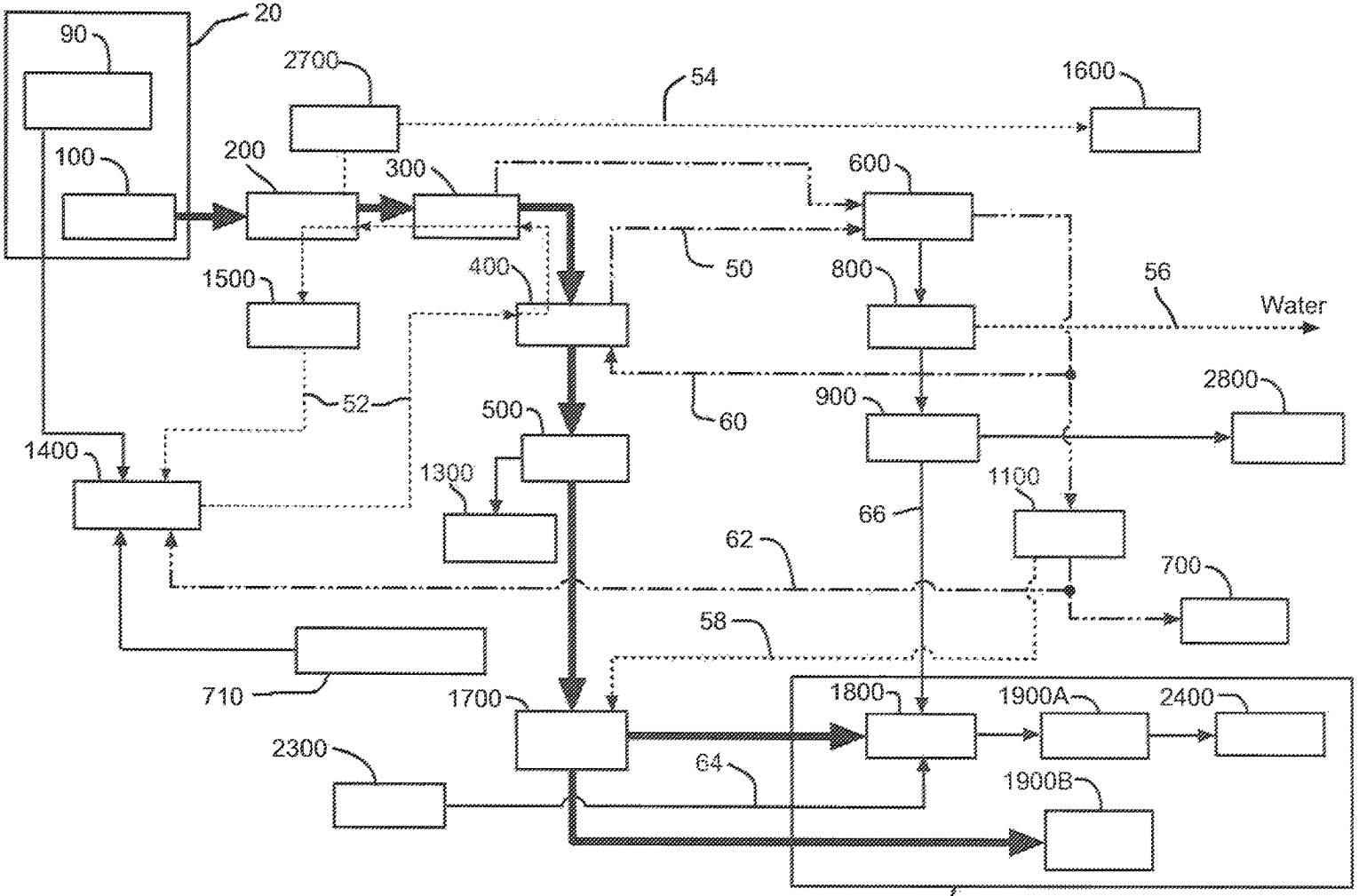
FIG. 1 is a schematic block diagram showing an overview of a coal pyrolysis and passivation operation.

FIG. 1 illustrates a generalized pyrolysis process. The process is generally well known and need not be described in detail. Briefly, in an upstream process 20, the coal is stored (at 90) and or prepared (at 100) for pyrolysis. Preparation 100 may include grinding or crushing large particles of coal and meshing or sizing to a more uniform size. Whereas char particles in the prior art were often 20 mm or larger, in the present invention, smaller particle sizes are generally used, for example −8 mesh, −5 mm mesh, or even smaller. Generally particle sizes are not smaller than about +0.5 mm Prepared coal is dried in one or more drying steps 200 and optionally preheated 300 before pyrolysis. During pyrolysis 400, direct and/or indirect heat is used to drive volatiles (path 50) from the coal, using processes such as those described in patents U.S. Pat. Nos. 8,470,134, 8,366,882, and 8,394,420, all to Rinker. Direct and/or indirect heat for the pyrolysis process may come from any source, including, for example, a steam boiler 1400. Preferably heat is conserved and recovered where possible. For example, by counter-current routing (path 52) the heat to the pyrolysis area 400 first, and then to preheating area 300 and drying area 200, heat retained from pyrolysis is reused in additional steps. This is shown in FIG. 1 by short-dashed lines.

The pyrolysis process produces three products, water vapor, effluent or evolved gases, and coal char. As shown in FIG. 1, water vapor may be recovered from coal drying 2700 (path 54), or from coal derived liquids 800, 1100 (paths 56, 58). The recovered water may optionally be treated 1600, or optionally re-used, such as at humidification steps described below. Vent gases during heating and pyrolysis may be collected at 600 and centrifuged to remove additional water at 800. Gases are cooled during recovery and condensed coal-derived liquids (CDL) may be filtered 900 and stored 2800. Although not shown in FIG. 1, the condensable CDL may be condensed in multiple fractions or segments using a multi-stage quench absorber as described in U.S. patent application Ser. No. 14/151,385 filed Jan. 9, 2014 to Rinker, et al.

Note that some portion of the volatiles driven from the coal may be reused as sweep gas (path 60) for heating the coal during pyrolysis. Some components of the coal volatiles do not condense at ambient temperatures and remain in a gaseous state known as syngas. Syngas may be burned off as a flare 700 or, preferably re-used as a fuel for the boiler (path 62). Alternatively, the boiler 1400 may be fueled by any other source of fuel 710, such as diesel fuel. The CDL and volatile process stream is shown in FIG. 1 by long-dashed-double-dot lines.

Solid coal products are shown in FIG. 1 with a heavy solid line. After cooling 500, the coal char is carried to a passivation area 1700. Prior to passivation, the char is known as "reactive" or "active" due to its propensity to self ignite in ambient conditions. This char reactivity is passivated in the passivation area 1700, as is described in greater detail below. Char is then led to one or more downstream processes 30 such as briquetting 1900A, or bagging 1900B. If briquetted, the char may be blended at 1800 with external binder drawn (path 64) from a storage area 2300 and/or with process products such as sludge and/or CDLs from the pyrolysis process (path 66). If bagged, the volatile content of the char is generally not supplemented, rendering the char more suitable for metallurgical applications.

Passivation Reactor

Passivation requires oxygen adsorption or uptake (aka chemisorption) by the char particles in the range of about 0.2% to about 0.7% by weight, or from about 0.3% to about 0.6% by weight, nominally about 0.5% by weight. Excessive oxygen uptake reduces the calorific value of the resultant char. Passivation also requires moisture or water uptake by the char particles in the range of about 3% to about 7% by weight, or from about 5% to about 6% by weight, nominally about 5.5% by weight.

Fluidized bed reactors are well known and operate on the principle that particulate matter can be made to behave like a fluid when subjected to a stream of gas flowing under a sufficient pressure. While the particles are behaving like a fluid, the surface area of the particles is more exposed, enabling faster chemical and physico-chemical reactions. Fluidized bed reactors have been utilized in the drying and heating processes of pyrolysis, but to our knowledge, no fluidized bed reactors with internal heat exchangers have been utilized in a char passivation process. Suitable fluidized bed reactors are commercially available from Carrier Vibrating Equipment Company, Louisville, Ky.

Figure 2A:
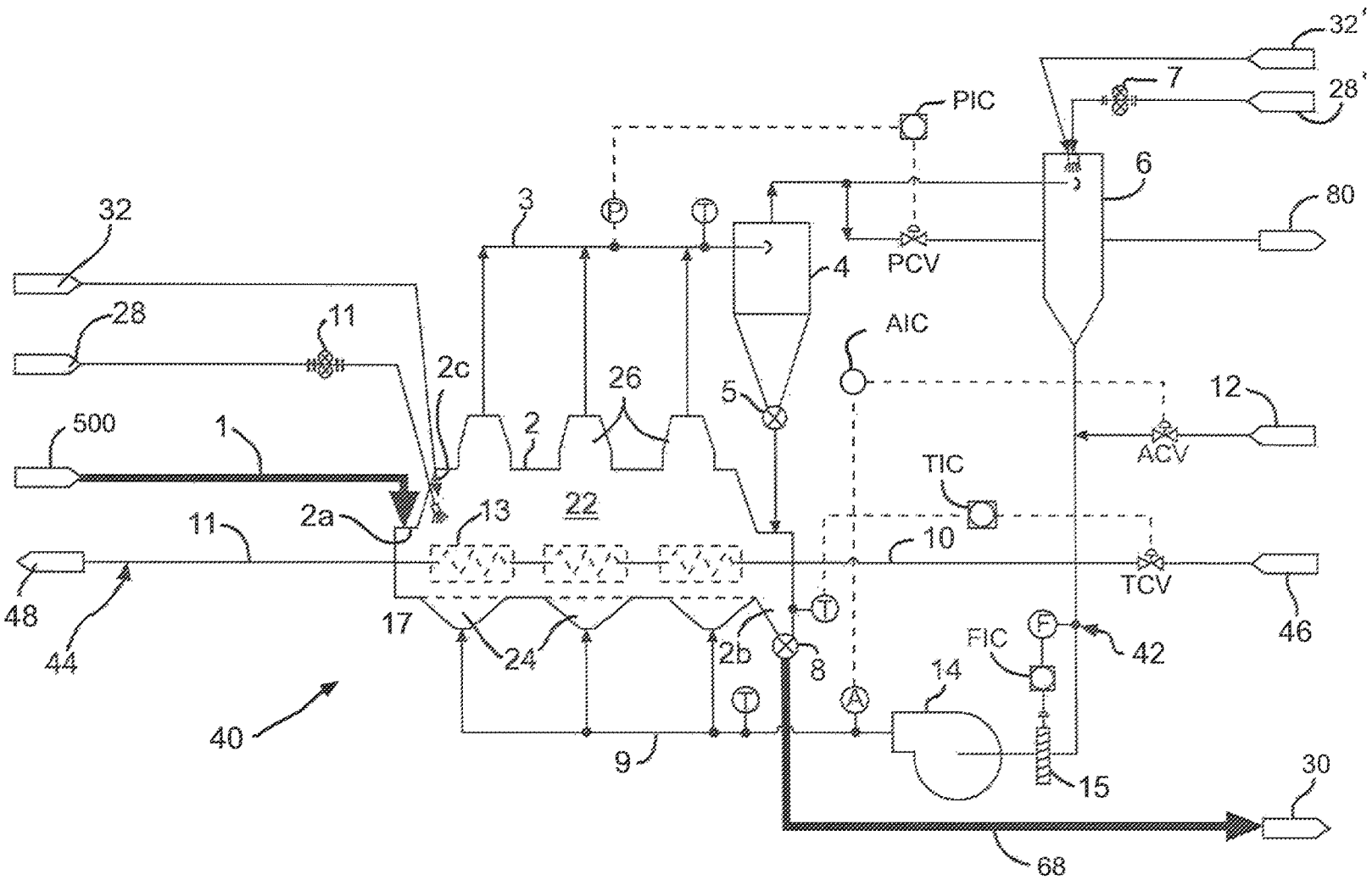
FIG. 2A is a schematic side elevation view of a char passivation reactor unit according to the invention.

Advantages of the present invention include smaller char particle sizes, which enable for the first time the use of fluidized bed reactors with internal heat exchangers for passivation, and increased surface area for a given mass of particle, which facilitates the kinetics of the chemical and physical reactions of passivation. These features contribute to much faster passivation times and lower particle residence times. For example, particle residence times in a continuous process may be on the order of about 60 minutes or less, about 45 minutes or less, or about 30 minutes or less. In some embodiments, the residence time is 60 minutes, ±20 minutes. In other embodiments, the residence time is 30 minutes, ±about 10 minutes FIG. 2A is a schematic view of a fluidized bed passivator system 40. The system 40 includes a reaction chamber 2, having a coal char inlet 2*a* to which active coal char is delivered (path 1), and a char sump 2*b* from which passivated char is removed via rotary valve 8 and path 68. The reaction chamber 2 defines an interior 22. The reaction chamber may optionally include a nozzle or spray head 2*c* at an upper portion of the chamber 2. Suitable atomizing nozzles are available from many companies, including Spraying Systems and Envirocare. For example, the J-series nozzles of Spraying Systems Company (Wheaton, Ill.) have been found to be suitable. The humidifying water is admitted to the char or reaction chamber in the physical form of a very fine mist or alternatively as water vapor.

The spray nozzle is fed by a source of water 28 (optionally filtered at 11) and optionally with a source of compressed air 32 for creating a spray or atomized spray of water from the spray head or nozzle 2*c* into the reaction chamber 2. The nozzle 2*c* is one mechanism for humidifying the char; an alternative method of humidification is described later in connection with the gas recirculation system 42. The fluidized passivator bed system 40 may utilize either one of the alternative humidification methods alone, or may use both in combination. If a spray nozzle 2*c* is utilized for humidification, it may be desirable to locate it near the coal inlet, and to avoid placing a heat exchanger (13, see later) directly beneath the spray nozzle 2*c*.

The reaction chamber 2 also has at least one gas inlet 24 for admitting a fluidizing gas into the interior 22, and at least one gas outlet 26 for exiting a fluidizing gas. The gas inlet 24 and the gas outlet 26 may also be viewed as part of a gas recirculation system 42, which circulates the gas from the gas outlet 26 back to the gas inlet 24. The gas recirculation system 42 also comprises various conduits or conducting paths (e.g. paths 3 and 9) and a fan or pump 14 for pressurizing the gas and driving it forward through conduit 9 into the reaction chamber 2. The gas inlet 24 is typically at the bottom of the reaction chamber 2, which allows the downward force of gravity to balance against the upward force of the gas stream to keep the particles "fluidized" in vertical motion. Meanwhile, continuous entry of new char material at char inlet 2*a* and removal of passivated char at sump/exit 2*b* produces a generally lateral flow from inlet to exit (from left to right in FIG. 2A), which enables continuous processing instead of batch processing.

The fluidizing gas may be any gas capable of fluidizing the char particles. In one embodiment the fluidizing gas is oxygen-depleted air; while in another embodiment, the fluidizing gas is a non-oxidative gas, such as nitrogen, carbon dioxide, or a combination of the above. However, as explained herein, the chemisorption of oxygen onto or into the char particles is an important component to the passivation process, so if an inert or non-oxidative gas is used, it is desirable to include a source of oxygen-containing gas as a makeup, as described below. Conversely, if too much oxygen is present, the char may adsorb too much oxygen, so pure air, at 23% by weight oxygen, is generally not used, except for initial start-up following a nitrogen purge. Thereafter, fluidizing air that is oxygen-depleted is used. An "oxygen-depleted" gas or fluid is one in which the oxygen content is less than about 15% by weight. In some embodiments, the fluidizing gas is depleted of oxygen by passing it through the char—which adsorbs some of the oxygen, and then recycling it as a fluidizing gas.

By weight, the oxygen content of the fluidizing gas should be at least 5% but less than about 15%. In some embodiments, the oxygen content of the fluidizing gas should be between about 7% and about 12% by weight. In embodiments where the spray nozzle 2*c* is used for humidification and the spray is atomized, the oxygen content of the atomizing gas should also be considered as a source of oxygen in the passivation reactor 2.

Optionally, the gas recirculation system 42 comprises a separator, such as cyclone separator 4. The cyclone separator 4 receives at a tangential inlet the fluidizing gas exiting the reaction chamber interior 22. This exiting gas may include some entrained particulates. Cyclone 4 spins the gas to allow the particulates to drop out of the entraining gas. The particulates are collected and, via rotary valve 5, are readmitted to the reaction chamber 2, preferably near the char sump 2*b*. Suitable cyclone separators are available from suppliers such as Ducon, 5 Penn Plaza, New York, N.Y.; Fisher-Klosterman, Louisville, Ky.; or Heumann Environmental, Jeffersonville, Ind. For example, some Heurmann units are designed to remove 95% of the minus 5 micron particulates carried in the fluidizing gas stream. Gas, free of entrained particulates, exits the top of the cyclone.

Optionally, the gas recirculation system 42 comprises a humidifier 6, which may optionally take the form of an additional cyclone device. The humidifier 6 receives at a tangential inlet the fluidizing gas exiting the separation cyclone 4 (or exiting the reaction chamber interior 22 if cyclone 4 is absent). Water from a source of water 28' optionally filtered (at 7), optionally atomized by a source of compressed gas 32' before being sprayed into the humidifier 6 to re-humidify the fluidizing gas before it is returned via conduits and pump 14 to the gas inlet 24 of the reaction chamber 2.

For control purposes, the gas recirculation system 42 may further comprise monitors or sensors for measuring concentration or level (A), temperature (T), pressure (P), and/or flow velocity (F), as well as valves or controllers that are responsive to these measurements. For example, FIG. 2A shows a pressure indicator controller (PIC) that opens a release valve (PCV) in response to too great a pressure measured in the fluidizing gas stream in conduit 3 as it exits the reaction chamber 2. This permits any overpressure of gas to be vented (at 80). Similarly, a flow indicator control (FIC) responsive to a flow measurement (F) may operate a flow control valve (FCV, 15) just prior to the fan or pump 14; and a temperature indicator control (TIC) responsive to a temperature sensor (T) may operate a temperature control valve (TCV) in coolant flow conduit 10 from coolant source 46.

Finally, the gas recirculation system 42 may further comprise a source of an oxygen-containing makeup gas, such as air 12 (or pure oxygen), having oxygen as a component. As has been explained, the chemisorptions of oxygen onto or into the char particles is an important component to the passivation process. An oxygen sensor (A) monitors the oxygen levels in the fluidizing gas and, in response, a controller (AIC) operates a valve (AVC) to admit more of the oxygen-containing gas 12.

Still referring to FIG. 2A, the passivator bed system 40 further comprises another system: coolant fluid system 44. Coolant fluid system 44 comprises a source of coolant fluid, such as coolant water supply 46. Coolant fluid system 44 is an "independent" and "internal" heat exchanger system. A conduit 10 leads the coolant to at least one heat exchanger 13, embedded within the interior 22 of the passivator reaction chamber 2. The heat exchanger 13 typically comprises coils or a labyrinth of tubes that increase the area of contact surfaces between the exchanger and the fluidized char particles, while not intermixing the coolant fluid with the fluidizing gas. There may be a plurality of heat exchangers 13, such as the three depicted in FIG. 2A. Multiple heat exchange units 13 may be arranged in parallel or in series, and in counter-current or co-current fashion relative to the increasing temperature gradient from char inlet 2*a* to char sump/outlet 2*b* due to the exothermic chemisorption reaction taking place within the chamber. In one embodiment, multiple heat exchange units are arranged in counter-current series fashion. An alternative embodiment is described below.

While the heat exchangers 13 are embedded within the reaction chamber 2, the coolant fluid system 44 is completely distinct from gas recirculation system 42 and the two never mix directly. After leaving the last heat exchanger 13, the coolant fluid exits the chamber 2 via conduit 11 and flows to a coolant return area 48. It will be noted that the coolant return area 48 may be looped back to the coolant supply area 46 via a conventional cooling tower (not shown), thus closing the coolant flow circuit. In this way, heat contained in the warm, pyrolized char and created by the exothermic chemisorption is extracted from the char as it is being fluidized. The increased surface area of the fluidized particulates and of the heat exchanger units embedded in the reaction bed allow for an extremely efficient cooling and passivation process. This in turn allows for a continuous process that can be operated more rapidly and with more control.

This careful control of reaction conditions is important for another reason. For the passivation process to proceed within a definite time period conducive to a continuous process, the temperature in the active fluidized bed is to be controlled to nominal 125° F., plus or minus about 10° F. (about 52° C.±6° C.) In various embodiments, the passivation temperature is carefully maintained from about 110° F. to about 140° F. (about 43° C. to about 60° C.), or from about 115° F. to about 135° F. (about 46° C. to about 57° C.), or from about 120° F. to about 130° F. (about 49° C. to about 54.5° C.).

Suitable fluidized bed reactors with heat exchanging coolant fluid systems are commercially available from Carrier Vibrating Equipment Company, Louisville, Ky.

Data from testing demonstrated that the exothermic heat release for the chemisorption and rehydration is in the order of 172,473 Btu (~181,960 kJ) per metric ton of char prepared from a sub-bituminous coal. The char typically has a specific heat absorption rate of 0.35 Btu per pound degree F. (~1.47 kJ per kg ° C.). In view of this exothermic heat release, it can easily be determined that the uncontrolled temperature increase could be as much as 225 degrees F. (about 125° C.). As such, the heat release, if uncontrolled, would increase the temperature of the dried coal char particles to temperature levels far in excess of those whence the rehydration moisture would adhere to the particles. The excess heat generated would have two negative effects. First, it would tend to evaporate the water before it could effectively hydrate the char. Second, it would cause over adsorption of oxygen, beyond desirable passivation levels, thereby reducing the calorific value of the char.

Figure 2B:
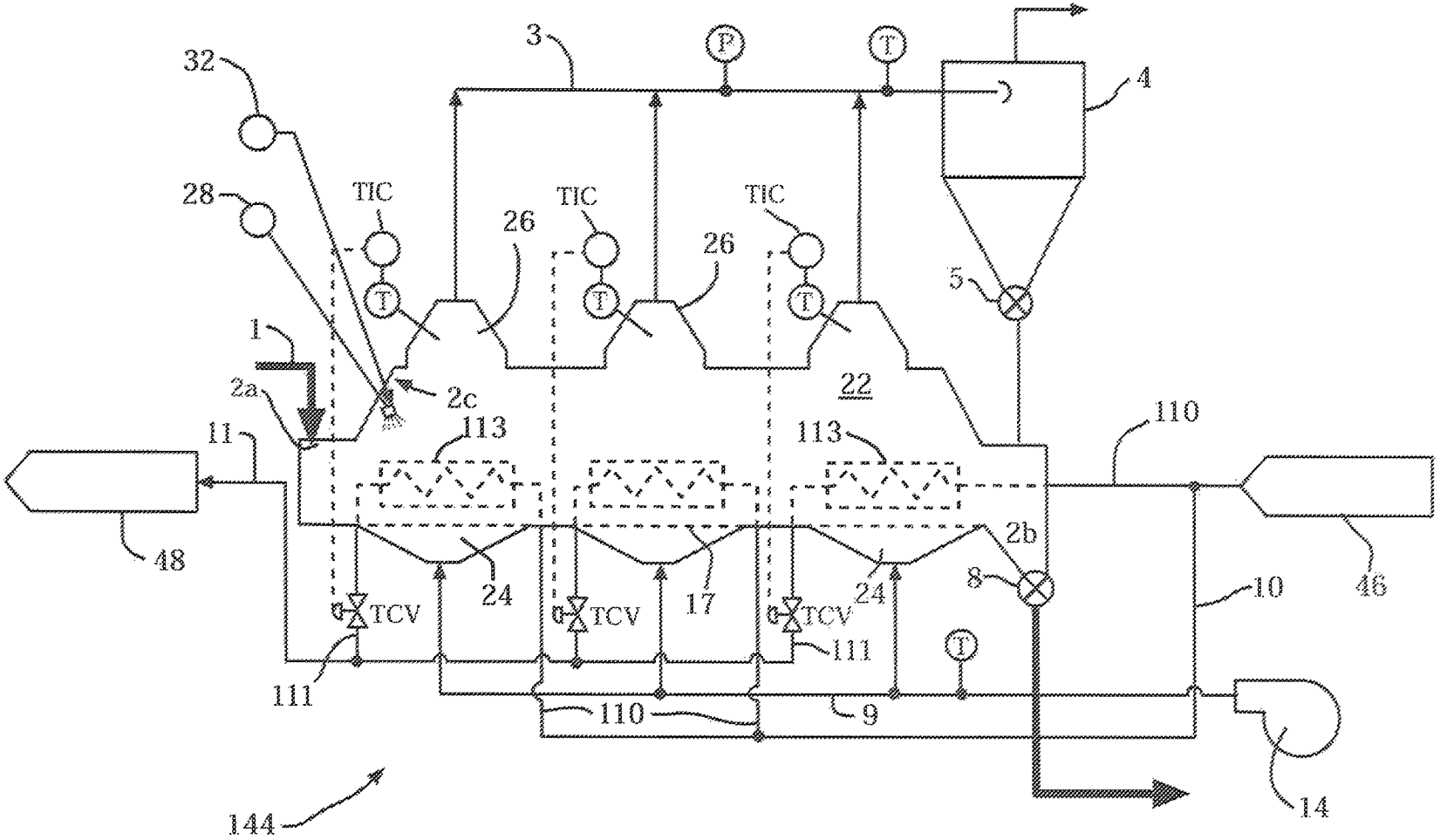
FIG. 2B is a schematic side elevation view of an alternative embodiment of a char passivation reactor unit according to the invention.

Experience indicates that the passivation reactions proceed rapidly when the solid particles are initially injected into the fluidized bed reaction unit. The rate of chemisorption and rehydration diminishes as the passivation process proceeds. Therefore, as shown in FIG. 2B, one embodiment of the apparatus is provided with a staged temperature coolant fluid system 144. Many of the components of this staged temperature coolant fluid system 144 are the same as coolant fluid system 44 described above, so only the features that are different are described here. In this embodiment, the plurality of heat exchange units 113 are not arranged in series, but in parallel, such that each unit 113 is independently supplied with coolant fluid via conduits 110. Coolant exits each unit 113 via conduits 111 that converge to conduit 11 leading to coolant return area 48. Temperature control valves (TCV) are inserted in lines 110 or 111 (shown) leading to each heat exchange unit 113 and these valves are controlled by multiple temperature indicator controls (TIC) that are responsive to the temperature monitored within the corresponding lateral sections of the reaction chamber 2, for example, at each gas outlet 26 near the top of the chamber 2 as indicated by temperature monitors (T).

The internal heat exchangers 113 are designed to independently control the temperature in each lateral section even as the heat release varies from the entry end (near 2*c*) to the exit end (near 2*b*) of the fluidized bed processing chamber. The coolant passes internally thru the internal embedded coils at flow rates controlled so as to remove the differing exothermic heat generation levels at successive stages along the reaction passageway. Thus, coolant may flow faster at the entry end so as to more rapidly remove the heat generated by the early, initial stage exothermic reaction, and more slowly near the exit end where the exothermic reaction has slowed. Likewise, the oxygen input/output concentration levels and the moisture input/output concentration levels can be staged so as to meet the varying demand levels as the passivation process matures in passing laterally (from left to right in FIGS. 2A and 2B) along the long axis of the reaction chamber.

As discussed above, fluidization causes the fine particles to move both vertically and horizontally, and continuous injection of fresh particles at the inlet end causes the particles to pass horizontally through the reaction chamber. The retention time can be controlled by increasing or decreasing the influx of untreated or active char particles and by moderately modulating the gas flow rate. Of necessity, the dried coal or coal char particles must have been carefully sized to facilitate fluidization and to expose the necessary surface area to facilitate the passivation reactions within a finite reaction chamber.

Figure 3:
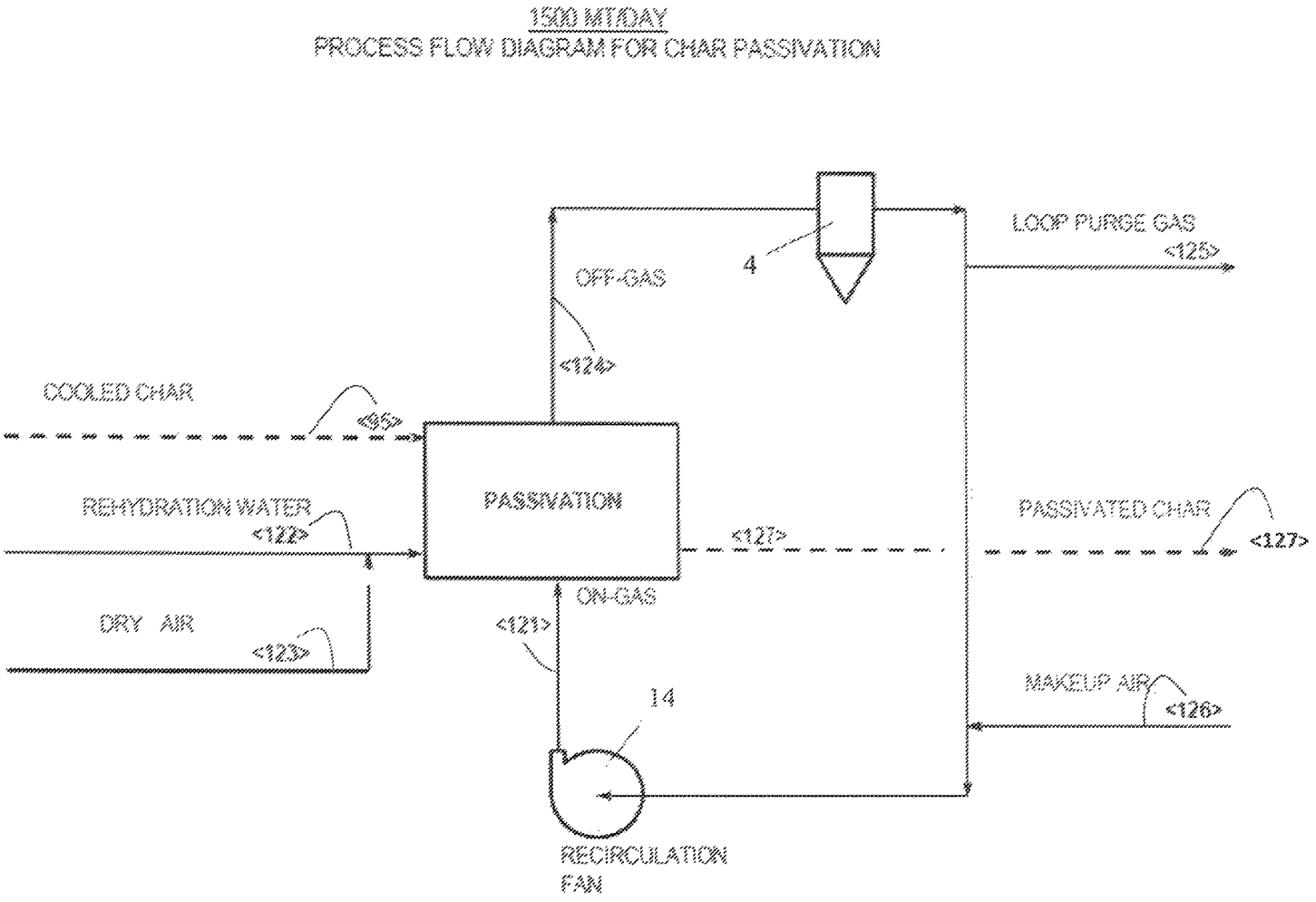
FIG. 3 is a flow process diagram for char passivations.

FIG. 3 illustrates the general passivation process. Bracketed numbers indicate points at which various measurements are taken. Cooled char enters via point <95> and exits via point <127>. In one embodiment, cooled char may enter at a rate of 30,948 kg/hr at about 48.9° C. and exit the passivation unit at a rate of about 32,805 kg/hr at about 51.7° C. The humidifier is indicated by inputs at points <122> for water, and <123> for air. In one embodiment, water at about 15.6° C. flows at 1,748 kg/hr and air at about 23.9° C. flows at about 540 kg/hr. The gas recirculation system 42 includes input gas at point <121> and exit gas at point <124> looping around through a cyclone separator 4 and a fan or pump 14. In one embodiment, on-gas at <121> includes 11.3% (wt/wt) oxygen and has 90% relative humidity at 46.1° C. and flows at 39,236 kg/hr; and at <124> off-gas at 43° C. flows at 39,667 kg/hr. Overpressure gas may be purged or vented at point <125> and makeup air can enter the gas recirculation system at point <126>. In one embodiment, purged gas at 43° C. flows at 1,100 kg/hr and makeup air at 15.6° C. flows at 668 kg/hr. FIGS. 4A (metric units) and 4B (English units) give additional flow and temperature information at the 8 point locations shown in FIG. 3 and discussed above (e.g. <95>, and <121> through <127>).

EXAMPLE 1

A coal pyrolysis and char passivation apparatus is set up substantially as described herein in connection with FIGS. 1 and 2A, for a fluidized bed reactor that is 7.5 ft (2.29 m) wide, 30 ft (9.14 m) long and having 66 inches (1.68 m) of fluidized depth. A target oxygen adsorption of 0.5% by weight is extrapolated to 11 lbs (5 kg) oxygen consumption per metric ton (1000 kg) of char. The exothermic chemisorption reaction yields 4500 Btu/lb (~10,466 kJ/kg) oxygen consumed, or about 49,500 Btu (52,222 kJ) per metric ton of char. A target moisture adsorption of 5.5% by weight is similarly extrapolated to 121.3 lbs (~55 kg) water vapor/metric ton of char. As this moisture condenses on the char, it yields 1014 Btu/lb (2358 kJ/kg) water vapor, or about 122,973 Btu (~129,737 kJ) per metric ton of char processed. Thus, the total exothermic heat released during passivation is 49,500+122,973=172,473 Btu (or 52,222+129,737=181,959 kJ) per metric ton of char. Char is processed at a flow rate of about 32.25 metric tons/hour generating a total heat flow rate of 32.25 metric tons×172,473 Btu (181,959 kJ)/metric ton=5,562,254 Btu (5,868,178 kJ) per hour. Allowing a safety factor of 1.1 (10%) the amount of heat that must be removed each hour to maintain a constant temperature in the passivator reactor bed is about 6,118,479 Btu (6,454,996 kJ). It would be prohibitive to remove heat at this rate using recycle gas flow only.

Assuming an internal coolant fluid is used, it is possible to calculate the required flow rate based reasonable assumptions. Assuming a coolant having a heat capacity of 0.5 Btu/lb (0.12 kJ/kg), and assuming a temperature change of 50° F. (28° C.), e.g. from about 85° F. (~29.4° C.) inlet to about 135° F. (57.2° C.) outlet temperature, to maintain the reaction chamber at about 125° F. (51.7° C.), implies that the coolant fluid is capable of removing 25 Btu/lb (58.2 kJ/kg) coolant. If 6,118,479 Btu (6,454,996 kJ) per hour need to be removed, the coolant must flow at about 244,759 lbs (111,020 kg) per hour in order to remove the anticipated exothermic heat load.

EXAMPLE 2

An embodiment of the invention using an external humidifier to inject moisture into the fluidizing gas is evaluated, using a fluidized reactor bed that is 7.5 ft (2.29 m) wide, 30 ft (9.14 m) long and having 66 inches (1.68 m) of fluidized depth. Nitrogen is used as the fluidizing gas at a design velocity of 86 ft/min, which equates to a flow rate of 19,350 SCFM or 86,500 lb (39,236 kg) dry gas/hr. Oxygen is admitted as required to facilitate the ongoing chemisorptions process. Assuming a char flow of about 32.25 metric tons/hour as in Example 1, and a 5.5% target moisture, implies that about 3910 lbs (~1775 kg)/hr of water are necessary to passivate the char. Rounding to 4000 lbs (or about 1800 kg) per hr for a safety factor, means that the vapor content of the Nitrogen fluidizing gas must be 4000/(86,500+4,000) [or 1800/(39.236+1800)]=~4.4% or 4.5% absolute humidity. At a typical average temperature of about 115° F. (46° C.), this represents a relative humidity of about 36%, which is easily attainable.

EXAMPLE 3

An embodiment of the invention using an atomized spray nozzle to supply moisture directly into the reaction chamber is evaluated, using a fluidized reactor bed that is 7.5 ft (2.29 m) wide, 30 ft (9.14 m) long and having 66 inches (1.68 m) of fluidized depth. The reaction chamber is fitted with eight internal mix atomizing nozzles (e.g. Spraying Systems models 1//2JSU89) for providing humidification. The water requirement of about 3950 lbs/hr (1792 kg/hr) is calculated and rounded as in Example 2, implying a water flow rate of 28,145 gallons/hr or 470 gallons/min (~1779 L/min). The example considers both nitrogen and air as atomizing gases.

It is important to note that in this spray humidifier embodiment, the humidifying water is admitted to the reaction chamber in the physical form of a very fine mist or alternatively as water vapor.

While the invention has been described with reference to various and preferred embodiments, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof.

The entire content of all US patents and patent applications and any other publication mentioned specifically in this application is hereby incorporated by reference.

Therefore, it is intended that the invention not be limited to the particular embodiment disclosed herein contemplated for carrying out this invention, but that the invention will include all embodiments falling within the scope of the claims.

What is claimed is:

1. A method for passivating coal char comprising:

fluidizing the coal char particles with a fluidizing gas stream injected into the reaction chamber of a fluidized bed reactor maintained at a temperature from about 110° F. to about 140° F. (about 43° C. to about 60° C.);

passivating the char particles as they are fluidized by contacting them with oxygen and moisture in the reaction chamber, wherein the char in the fluidized bed reacts with oxygen exothermically and takes up moisture from about 3% to about 7% by weight; and cooling the char particles as they are fluidized and reacted exothermically by contacting them with an internal heat exchange system having heat exchange surfaces within the fluidized bed reactor.

2. The method of claim 1, further comprising chemisorbing oxygen onto the surfaces or into the pores of the coal char particles.

3. The method of claim 1, further comprising contacting the coal char particles with moisture by spraying water into the fluidized reaction chamber.

4. The method of claim 1, further comprising contacting the coal char particles with moisture by spraying water into the fluidizing gas stream prior to injecting it into the chamber.

5. The method of claim 1, further comprising separating any char particulates carried out of the chamber by the fluidizing gas stream from the gas stream using a cyclone separator and returning the particulates to the chamber.

6. The method of claim 1 wherein the temperature of the char in the fluidized bed reaction chamber is maintained from about 115° F. to about 135° F. (about 46° C. to about 57° C.).

7. The method of claim 1 wherein the char particles are completely passivated in a time less than about 60 minutes.

8. The method of claim 1 wherein the char in the fluidized bed reactor takes up oxygen from about 0.2% to about 0.7% by weight.

9. The method of claim 1 wherein the char in the fluidized bed reactor takes up moisture from about 4% to about 6% by weight.

10. The method of claim 8 wherein the char in the fluidized bed reactor takes up oxygen from about 0.3% to about 0.6% by weight.

11. The method of claim 1 wherein the fluidized bed reactor includes multiple lateral sections each containing separate internal heat exchanger systems and temperature controls, the method further comprising maintaining the temperature of the char in a first lateral section independently from the temperature of the char in a second lateral section.

12. The method of claim 11 further comprising controlling coolant flow through the internal heat exchangers such that heat is removed more rapidly from a first lateral section than a subsequent lateral section.

* * * * *